US011180964B2

(12) United States Patent
Nield et al.

(10) Patent No.: US 11,180,964 B2
(45) Date of Patent: Nov. 23, 2021

(54) INTERLOCK FOR A DRILL RIG AND METHOD FOR OPERATING A DRILL RIG

(71) Applicants: Barry J. Nield, Jacksonville Beach, FL (US); George A. Nield, Jacksonville Beach, FL (US)

(72) Inventors: Barry J. Nield, Jacksonville Beach, FL (US); George A. Nield, Jacksonville Beach, FL (US)

( * ) Notice: Subject to any disclaimer, the term of this patent is extended or adjusted under 35 U.S.C. 154(b) by 210 days.

(21) Appl. No.: 16/545,738

(22) Filed: Aug. 20, 2019

(65) Prior Publication Data

US 2021/0054698 A1 Feb. 25, 2021

(51) Int. Cl.
*E21B 19/00* (2006.01)

(52) U.S. Cl.
CPC ..... *E21B 19/008* (2013.01)

(58) Field of Classification Search
CPC ..... E21B 19/00–24
See application file for complete search history.

(56) References Cited

U.S. PATENT DOCUMENTS 8,517,090 B2 8/2013 Haugen
9,797,208 B2 10/2017 Mosing
9,995,095 B2 6/2018 Thibodeaux
10,138,690 B2 11/2018 Odell, II
10,196,867 B2 2/2019 Mailly
10,253,581 B2 4/2019 Wiedecke
10,287,832 B2 5/2019 Cordes
10,422,188 B2 9/2019 Zheng
2008/0149326 A1* 6/2008 Angelle ..... E21B 19/10 166/77.52
2008/0203734 A1* 8/2008 Grimes ..... E21B 3/02 290/40 R
2018/0171760 A1* 6/2018 Zheng ..... E21B 21/01

* cited by examiner

*Primary Examiner* — Kristyn A Hall
(74) *Attorney, Agent, or Firm* — Steve LeBlanc, LLC

(57) ABSTRACT

An interlock between a drawworks and a segment hoist includes a sensor for sensing a position of the segment hoist. An interlock signal is generated by the sensor for sensing the position of the segment hoist and is reflective of the position of the segment hoist. A lock operably connected to the drawworks receives the interlock signal and disables operation of the drawworks if the interlock signal meets a predetermined criterion. A method for operating a drill rig includes operating a drawworks to raise and lower a drill string and operating a segment hoist. The method further includes sensing a position of the segment hoist, generating an interlock signal that reflects the position of the segment hoist, and disabling the drawworks if the interlock signal meets a predetermined criterion.

19 Claims, 4 Drawing Sheets

INTERLOCK FOR A DRILL RIG AND METHOD FOR OPERATING A DRILL RIG

FIELD OF THE INVENTION

The present invention generally involves an interlock for a drill rig and a method for operating the drill rig. Particular embodiments of the present invention may be incorporated into land-based or offshore drill rigs used for oil/gas production and/or well service operation to reduce or prevent personnel injury or equipment damage when changing the length of a drill string.

BACKGROUND OF THE INVENTION

Drill rigs are commonly used in oil and gas production and well service operations to bore substantial distances below the earth's surface. A drill rig generally includes a drawworks for raising and lowering a drill string in a borehole. The drawworks generally includes a large drum or spool that holds a cable. The cable extends from the drum to a derrick that supports a block and tackle arrangement holding a traveling block. The traveling block provides a mechanical advantage for raising and lowering the drill string in the borehole. A clutch releasably connects a drive system to the drum to rotate the drum to reel in the cable. To lower the drill string, the clutch may disengage the drive train from the drum, and a brake connected to the drum may be released to allow the weight of the drill string to rotate the drum to release the cable from the drum.

The drill string refers to segments of pipe serially connected to extend into the borehole. The drill string may include hundreds of segments, and each segment may be approximately thirty feet in length and weigh several hundred pounds. As a result, a segment hoist may be used to transfer segments to or from the drill string. For example, the segment hoist may be connected near the top of the derrick and include a bale that can be extended or retracted as needed to lift and reposition segments being added to or removed from the drill string.

The addition and removal of segments typically involves coordinated efforts between multiple operators on the drill rig. For example, segments to be added to the drill string may be pre-positioned in a segment basket near the drill string, and a segment hoist operator stationed in the segment basket may operate the segment hoist to lift and reposition segments with respect to the drill string. One or more floor operators stationed on the floor of the drill rig may then connect or disconnect segments from the drill string and operate the drawworks to raise or lower the drill string.

The repetitive nature of adding and removing segments from the drill string, noise associated with the operations, the weight of the segments and equipment manipulating the segments, and various other personnel and environmental factors create an inherently dangerous operating environment. For example, operation of the drawworks to lower the drill string while the segment hoist is connected to a segment attached to the drill string can seriously damage the segment hoist and injure operators on the drill rig that interrupts operations, requires expensive repairs and training, and leads to lost revenue. Therefore, the need exists for an improved drill rig and method for operating the drill rig that incorporates one or more interlocks to protect the segment hoist and ensure safe and reliable operation of the drill rig.

BRIEF DESCRIPTION OF THE INVENTION

Aspects and advantages of the invention are set forth below in the following description, or may be obvious from the description, or may be learned through practice of the invention.

One embodiment of the present invention is an interlock between a drawworks and a segment hoist that includes a means for sensing a position of the segment hoist. An interlock signal is generated by the means for sensing the position of the segment hoist and is reflective of the position of the segment hoist. A lock operably connected to the drawworks receives the interlock signal and disables operation of the drawworks if the interlock signal meets a predetermined criterion.

An alternate embodiment of the present invention is an interlock for a drill rig that includes a drawworks having a drum operably connected to a drive system and a brake. A cable extends from the drum of the drawworks to a block and tackle arrangement holding a traveling block, and operation of the drawworks causes the drum to release or retract the cable. The interlock further includes a segment hoist and a means for sensing a position of the segment hoist. An interlock signal is generated by the means for sensing the position of the segment hoist, and the interlock signal is reflective of the position of the segment hoist. A lock operably connected to the drawworks receives the interlock signal and disables operation of the drawworks if the interlock signal meets a predetermined criterion.

In yet another embodiment of the present invention, a method for operating a drill rig includes operating a drawworks to raise and lower a drill string and operating a segment hoist. The method further includes sensing a position of the segment hoist, generating an interlock signal that reflects the position of the segment hoist, and disabling the drawworks if the interlock signal meets a predetermined criterion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
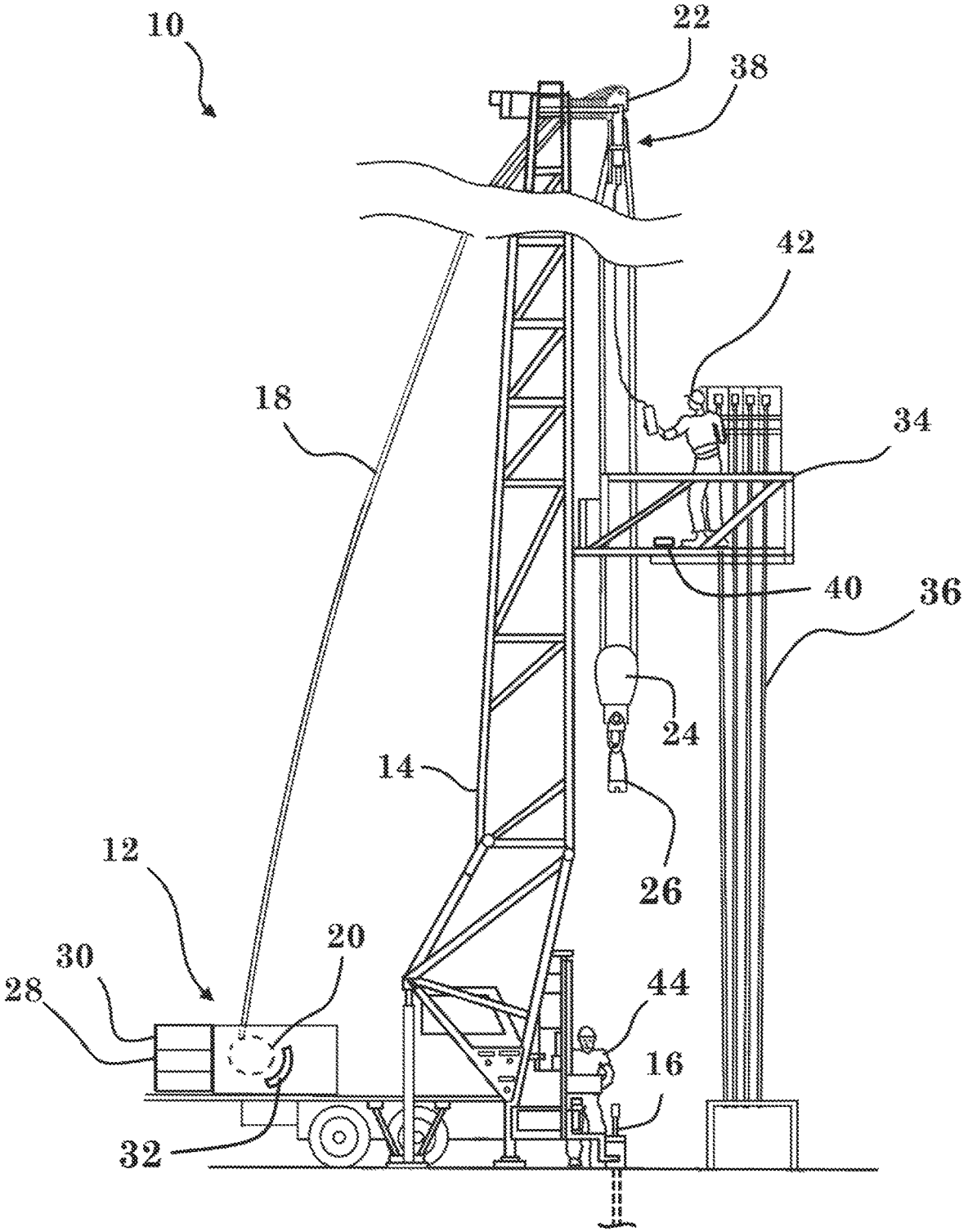
FIG. 1 is a representative drawing of a drill rig according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used in the claims, the definite article "said" identifies required elements that define the scope of embodiments of the claimed invention, whereas the definite article "the" merely identifies environmental elements that provide context for embodiments of the claimed invention that are not intended to be a limitation of any claim.

Embodiments of the present invention include a drill rig and method for operating the drill rig that incorporate one or more interlocks to ensure safe and reliable operation of the drill rig. Referring now to the drawings, wherein identical numerals indicate the same elements throughout the figures, FIG. 1 provides a representative drawing of a drill rig 10 according to one embodiment of the present invention. As shown in FIG. 1, the drill rig 10 generally includes a drawworks 12 and associated derrick 14 for raising and lowering a drill string 16 in a borehole. The drawworks 12 generally includes a cable 18 wound around a drum 20. The cable 18 may extend along the derrick 14 to a block and tackle arrangement 22 holding a traveling block 24. A collar 26 connected to the traveling block 24 may be used to releasably connect the drawworks 12 to the drill string 16. A clutch 28 may releasably connect a drive system 30 to the drum 20 to allow the drive system 30 to rotate the drum 20 to reel in the cable 18. To lower the drill string 16, the clutch 28 may disengage the drive system 30 from the drum 20, and a brake 32 connected to the drum 20 may be released to allow the weight of the drill string 16 and traveling block 24 to rotate the drum 20 to release the cable 18. Using this arrangement, as is well-known in the industry, operation of the drawworks 12 causes the drum 20 to release or retract the cable 18 as desired to raise and lower the drill string 16.

As shown in FIG. 1, a segment basket 34 may be located near the derrick 14 to provide a staging area for segments 36 to be added to or removed from the drill string 16. A segment hoist 38 may be connected near the top of the derrick 14, and an actuator 40, such as foot pedals or a switch, may be located in the segment basket 34 for operating the segment hoist 38. In this manner, a segment hoist operator 42 may be stationed in the segment basket 34 to operate the segment hoist 38 using the actuator 40. One or more floor operators 44 may be stationed on the floor of the drill rig 10 to connect or disconnect segments 36 from the drill string 16 and operate the drawworks 12 to raise or lower the drill string 16.

Figure 2:
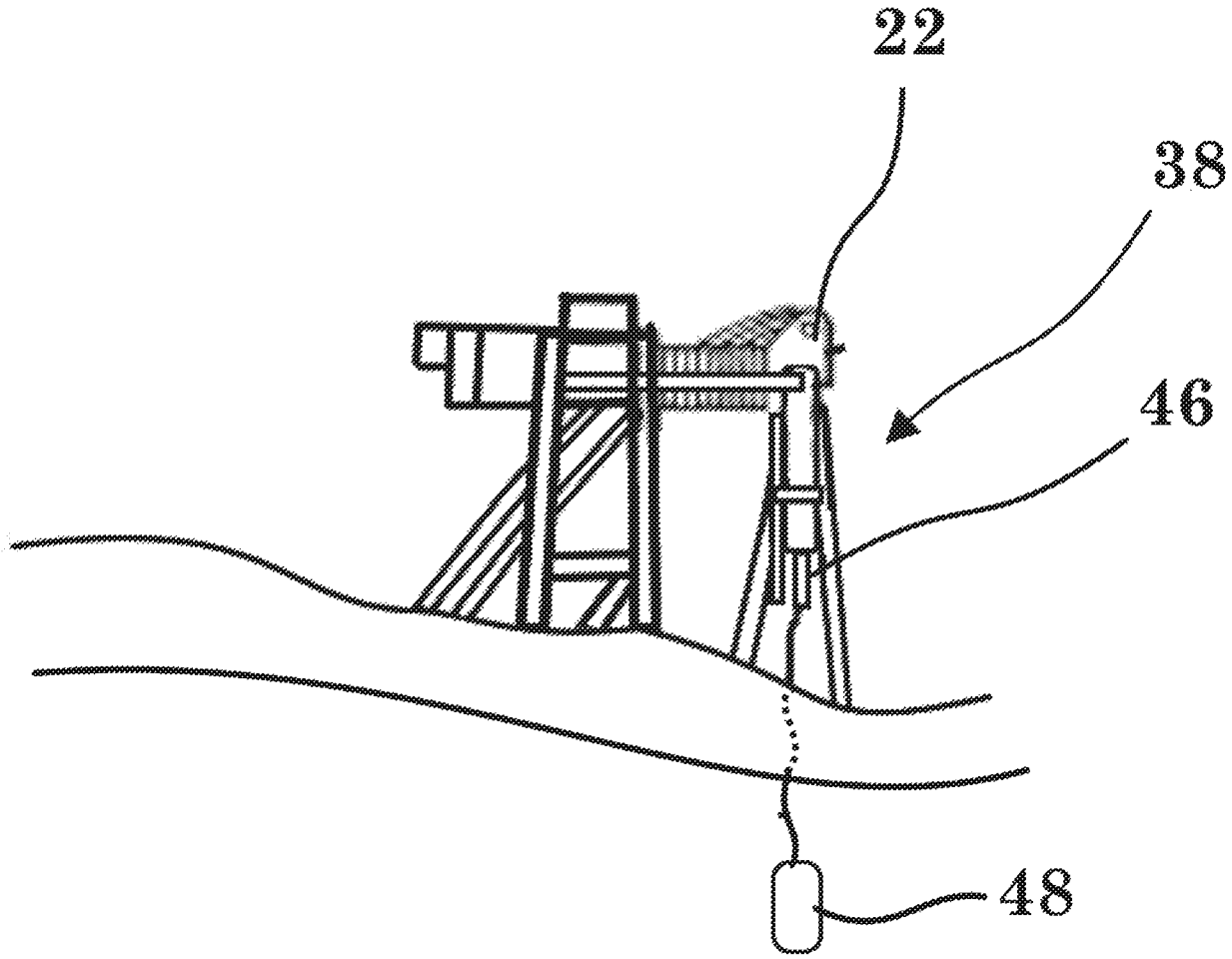
FIG. 2 is an enlarged view of a segment hoist shown in FIG. 1.

FIG. 2 provides an enlarged view of an exemplary segment hoist 38 as shown in FIG. 1 The segment hoist 38 may be any pneumatic, hydraulic, or electrical machine that assists the segment hoist operator 42 to lift and reposition segments 36 with respect to the drill string 16 and segment basket 34, and embodiments of the present invention are not limited to any particular segment hoist unless specifically recited in the claims. As shown in FIG. 2, for example, the segment hoist 38 may include a piston 46 connected to a bale 48. The segment hoist operator 42 may operate the segment hoist 38 as needed to extend or retract the piston 46 and bale 48 to connect the bale 48 to segments 36 to lift and reposition segments 36 with respect to the drill string 16 and segment basket 34.

Figure 3:
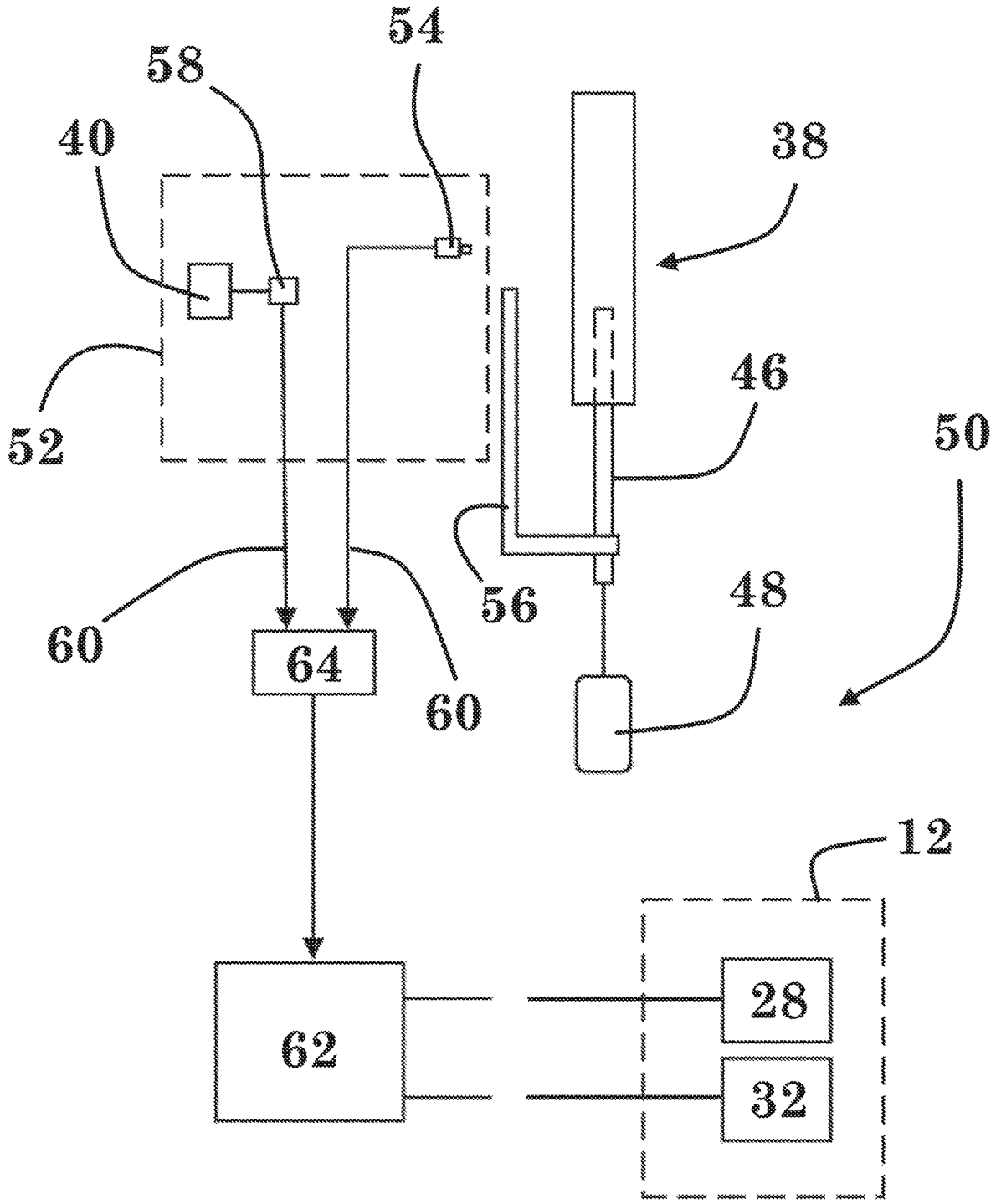
FIG. 3 is a functional block diagram of an interlock according to one embodiment of the present invention.

FIG. 3 provides a functional block diagram of an interlock 50 between the drawworks 12 and the segment hoist 38 according to one embodiment of the present invention. The interlock 50 includes a means 52 for sensing a position of the segment hoist 38. The function of the means is to sense the position of the segment hoist 38, e.g., whether the segment hoist 38 is fully retracted, extended, connected to a segment 36, etc. The structure for performing this function may include one or more sensors that monitor one or more components of the segment hoist 38 to determine the position of the segment hoist 38. The particular sensor for performing this function may be a reed switch, a photoelectric sensor, a magnetic field sensor, a proximity sensor, or any other sensor known to one of ordinary skill in the art for sensing one or more components of the segment hoist 38.

In one particular embodiment shown in FIG. 3, for example, the structure for sensing the position of the segment hoist 38 may be a proximity sensor 54 located next to the segment hoist 38 to detect when the piston 46 inside the segment hoist 38 is adjacent to the proximity sensor 54. In this manner, the proximity sensor 54 may detect when the piston 46 is in any position other than fully retracted inside the segment hoist 38, indicating that the segment hoist 38 is not fully retracted. If detection of the piston 46 inside the segment hoist 38 is unreliable due to mechanical interference, a repeater bar 56 may be optionally attached to the piston 46 to travel with the piston 46 outside of the segment hoist 38. In this manner, the proximity sensor 54 may be located next to the repeater bar 56 to detect when the repeater bar 56, and thus the piston 46, is other than fully retracted.

FIG. 3 illustrates an alternate embodiment of the means 52 for sensing the position of the segment hoist 38 in which the structure for the means is an actuator sensor 58 operably connected to the actuator 40 for operating the segment hoist 38. For this particular embodiment, the actuator sensor 58 may detect a position of the actuator 40, such as foot pedals or a switch in the segment basket 34, to determine if the segment hoist 38 is fully retracted or extended.

In yet another particular embodiment, the segment hoist 38 may include a reel that alternately retracts or releases cable to retract or extend the bale 48. For this particular embodiment, the structure for sensing the position of the segment hoist 38 may be a sensor that measures the length of cable inside the segment hoist 38 or extended from the segment hoist 38 to determine if the segment hoist 38 is fully retracted or extended. Another means 52 for sensing the position of the segment hoist 38 may be a sensor to determine if the bale 48 is connected to any segment 36. For example, the sensor may magnetically or electrically detect the presence of any segment 36 in contact with the bale 48 which would only be possible if the segment hoist 38 were not fully retracted. Alternately, the means 52 for sensing the position of the segment hoist 38 may be a sensor that indicates a weight, such as a segment 36, being supported by the bale 48 or segment hoist 38. One of ordinary skill in the art will readily appreciate other sensors that may be used to monitor one or more components of the segment hoist 38 to determine whether the segment hoist 38 is fully retracted, extended, connected to a segment 36, etc., and the means for sensing the position of the segment hoist 38 includes each of these sensors and their equivalents.

The means 52 for sensing the position of the segment hoist 38 generates an interlock signal 60 reflective of the position of the segment hoist 38. For the embodiment shown in FIG. 3 having the proximity sensor 54, for example, the proximity sensor 54 may generate the interlock signal 60 to reflect that the piston 46 is not fully retracted inside the segment hoist 38. Alternately, for the embodiment shown in FIG. 3 having the actuator sensor 58, the actuator sensor 58 may generate the interlock signal 60 to reflect that the actuator 40 has been positioned to extend the segment hoist 38.

As shown in FIG. 3, the interlock 50 between the drawworks 12 and the segment hoist 38 further includes a lock 62 operably connected to the drawworks 12 to receive the interlock signal 60 and disable operation of the drawworks 12 if the interlock signal 60 meets a predetermined criterion. The lock 62 may be a valve, switch, solenoid, or other device known to one of ordinary skill in the art that produces an output in response to the predetermined criterion. As shown in FIG. 3, the output from the lock 62 may disable operation of the drawworks 12 by actuating the brake 32, releasing the clutch 28, and/or otherwise disabling the drive system 30.

The predetermined criterion may be selected to prevent operation of the drawworks 12 when the segment hoist 38 is in any position that would allow the segment hoist 38 to be connected to any segment 36. For example, the segment hoist 38 cannot be connected to any segment 36 when the segment hoist 38 is fully retracted. As a result, the predetermined criterion may be any interlock signal 60 that indicates the segment hoist 38 is in any position other than fully retracted. Referring to the embodiments shown in FIG. 3, for example, the lock 62 may disable operation of the drawworks 12 when the interlock signal 60 generated by the proximity sensor 54 indicates an absence of the piston 46 in proximity to the proximity sensor 54—i.e., the proximity sensor 54 fails to detect the piston 46. Alternately, the lock 62 may disable operation of the drawworks 12 when the interlock signal 60 generated by the actuator sensor 58 indicates that the actuator 40 has been positioned to extend the segment hoist 38.

As shown in FIG. 3, the interlock 50 may optionally include a controller 64 operably connected between the means 52 for sensing the position of the segment hoist 38 and the lock 62 to selectively transmit the interlock signal 60 to the lock 62. The controller 64 may be located, for example, in the segment basket 34 to allow the segment hoist operator 42 to manually interrupt transmission of the interlock signal 60 to the lock 62, or alternately to manually transmit a desired interlock signal 60 to the lock 62, thereby providing a manual override of the interlock 50.

Figure 4:
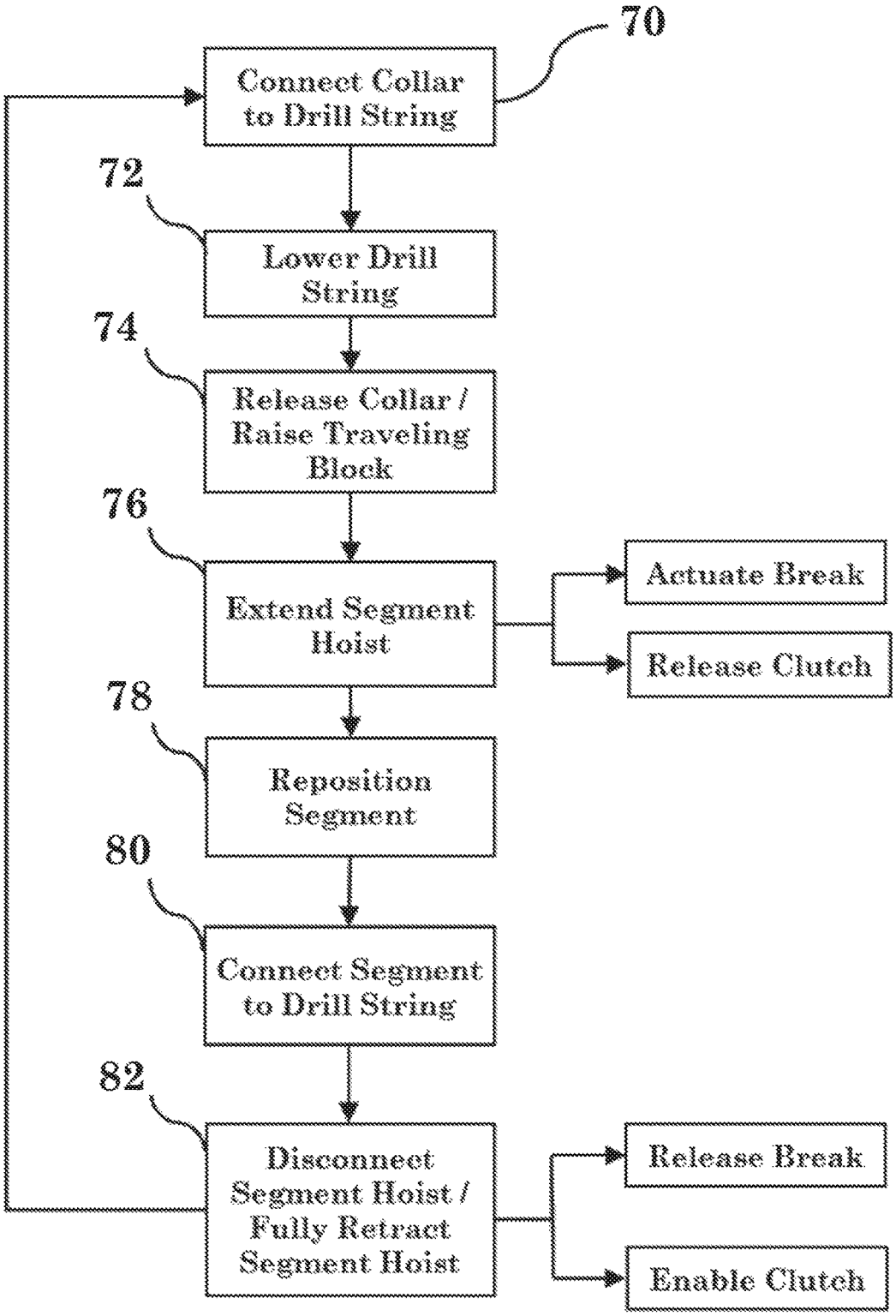
FIG. 4 is a flow diagram of a method for operating the drill rig according to one embodiment of the present invention.

FIG. 4 provides a flow diagram of a method for operating the drill rig 10 according to one embodiment of the present invention. At block 70, with the segment hoist 38 fully retracted or otherwise disconnected from any segment 36, the segment hoist operator 42 connects the collar 26 of the drawworks 12 to the topmost segment 36 connected to the drill string 16. At block 72, the interlock 50 enables operation of the drawworks 12, and the floor operator 44 operates the drawworks 12 to lower the drill string 16 to the floor of the drill rig 10. At block 74, the floor operator 44 secures the drill string 16 in place, releases the collar 26 from the drill string 16, and operates the drawworks 12 to raise the traveling block 24 to the segment basket 34 in preparation for adding another segment 36 to the drill string 16.

At block 76, the segment hoist operator 42 operates the actuator 40 to extend the segment hoist 38. As the segment hoist 38 extends, the interlock 50 disables operation of the drawworks 12 by actuating the brake 32, releasing the clutch 28, or otherwise disabling the drive system 30. At block 78, the segment hoist operator 42 connects the bale 48 to a new segment 36 and repositions the segment 36 above the drill string 16. At block 80, the floor operator 44 connects the new segment 36 to the drill string 16. At block 82, the segment hoist operator 42 disconnects the bale 48 from the segment 36 and fully retracts the segment hoist 38. Once the segment hoist 38 is fully retracted, the interlock 50 enables operation of the drawworks 12 by releasing the brake 32, engaging the clutch 28, or otherwise enabling the drive system 30. The method then repeats with the segment hoist operator 42 again connecting the collar 26 of the drawworks 12 to the newly added topmost segment 36 connected to the drill string 16. One of ordinary skill in the art will appreciate that the process for removing segments 36 from the drill string 16 would be similar.

The interlock 50 and method for operating the drill rig 10 thus provides enhanced safety and protection for both equipment and personnel by preventing inadvertent operation of the drawworks 12 while the segment hoist 38 is engaged with any segment 36.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. An interlock between a drawworks and a segment hoist, the interlock comprising:

a means for sensing a position of the segment hoist;

an interlock signal generated by said means for sensing the position of the segment hoist, wherein said interlock signal is reflective of the position of the segment hoist; and a lock operably connected to the drawworks, wherein said lock receives said interlock signal and disables any operation of the drawworks in either direction as long as said interlock signal meets a predetermined criterion.

2. The interlock as in claim 1, wherein the segment hoist comprises a piston that may be extended or retracted, and said means for sensing the position of the segment hoist comprises a proximity sensor that senses a position of the piston in the segment hoist and generates said interlock signal.

3. The interlock as in claim 2, wherein said predetermined criterion indicates an absence of the piston in proximity to said proximity sensor.

4. The interlock as in claim 1, wherein the segment hoist comprises an actuator that controls operation of the segment hoist, and said means for sensing the position of the segment hoist comprises a sensor that senses a position of the actuator that controls operation of the segment hoist and generates said interlock signal.

5. The interlock as in claim 4, wherein said predetermined criterion indicates a position of the actuator that controls operation of the segment hoist.

6. The interlock as in claim 1, wherein the drawworks comprises a brake and a clutch, and said lock disables operation of the drawworks by at least one of actuating the brake or releasing the clutch.

7. The interlock as in claim 1, further comprising a controller operably connected between said means for sensing the position of the segment hoist and said lock, and said controller selectively transmits said interlock signal to said lock.

8. An interlock for a drill rig, comprising:

a drawworks comprising a drum operably connected to a drive system and a brake;

a cable that extends from said drum of said drawworks to a block and tackle arrangement holding a traveling block, wherein operation of said drawworks causes said drum to release or retract said cable;

a segment hoist;

a means for sensing a position of said segment hoist;

an interlock signal generated by said means for sensing said position of said segment hoist, wherein said interlock signal is reflective of said position of said segment hoist; and a lock operably connected to said drawworks, wherein said lock receives said interlock signal and disables any operation of said drawworks in either direction as long as said interlock signal meets a predetermined criterion.

9. The interlock as in claim 8, wherein said segment hoist comprises a piston that may be extended or retracted, and said means for sensing said position of said segment hoist comprises a proximity sensor that senses a position of said piston in said segment hoist and generates said interlock signal.

10. The interlock as in claim 9, wherein said predetermined criterion indicates the absence of said piston in proximity to said proximity sensor.

11. The interlock as in claim 8, wherein said segment hoist comprises an actuator that controls operation of said segment hoist, and said means for sensing said position of said segment hoist comprises a sensor that senses a position of said actuator that controls operation of said segment hoist and generates said interlock signal.

12. The interlock as in claim 11, wherein said predetermined criterion indicates a position of said actuator that controls operation of said segment hoist.

13. The interlock as in claim 8, wherein said lock disables operation of said drawworks by at least one disabling said drive system or actuating said brake.

14. The interlock as in claim 8, further comprising a controller operably connected between said means for sensing said position of said segment hoist and said lock, and said controller selectively transmits said interlock signal to said lock.

15. A method for operating a drill rig, comprising:

operating a drawworks to raise and lower a drill string;

operating a segment hoist;

sensing a position of the segment hoist;

generating an interlock signal that reflects the position of the segment hoist; and disabling any operation of the drawworks in either direction as long as said interlock signal meets a predetermined criterion.

16. The method as in claim 15, further comprising sensing a position of a piston in the segment hoist and generating said interlock signal based on the position of the piston in the segment hoist.

17. The method as in claim 15, further comprising sensing a position of an actuator for the segment hoist and generating said interlock signal based on the position of the actuator for the segment hoist.

18. The method as in claim 15, further comprising disabling operation of the drawworks by at least one of disabling a drive system or actuating a brake associated with the drawworks.

19. The method as in claim 15, further selectively transmitting said interlock signal to disable the drawworks.

* * * * *